United States Patent [19]

Stephan

[11] 4,127,359

[45] Nov. 28, 1978

[54] TURBOMACHINE ROTOR HAVING A SEALING RING

[75] Inventor: Norbert Stephan, Dachau, Germany

[73] Assignee: Motoren-Und Turbinen-Union Munchen GmbH, Munich, Germany

[21] Appl. No.: 793,997

[22] Filed: May 5, 1977

[30] Foreign Application Priority Data

May 11, 1976 [DE] Fed. Rep. of Germany ..... 2620762

[51] Int. Cl.[2] ..... F01D 5/06

[52] U.S. Cl. ..... 416/198 A; 416/201 R

[58] Field of Search ..... 416/198 A, 193 A, 200 A, 416/201 R; 415/218

[56] References Cited

U.S. PATENT DOCUMENTS

| | | | |
|---|---|---|---|
| 2,356,605 | 8/1944 | Meininghaus | 416/193 A X |
| 2,579,745 | 12/1951 | Lombard et al. | 416/201 |
| 3,295,825 | 1/1967 | Hall | 416/193 A X |
| 3,689,177 | 9/1972 | Klassen | 416/198 A |
| 3,894,324 | 7/1975 | Holzapfel | 416/201 X |
| 3,972,645 | 8/1976 | Kasprow | 416/193 A X |

FOREIGN PATENT DOCUMENTS

| | | | |
|---|---|---|---|
| 1,182,474 | 11/1964 | Fed. Rep. of Germany | 416/193 A |
| 71,754 | 2/1953 | Netherlands | 416/198 A |
| 709,748 | 6/1954 | United Kingdom | 416/198 A |
| 885,951 | 1/1962 | United Kingdom | 416/198 A |

*Primary Examiner*—Everette A. Powell, Jr.
*Attorney, Agent, or Firm*—Alan H. Levine

[57] ABSTRACT

A rotor of a jet engine turbine or compressor includes a plurality of disks each carrying radially extending blades. An annular spacer having a substantially double-T-shaped cross-section is located between two successive disks. One end of the spacer and one of the disks define an annular space between them. A gap exists between the one disk and the spacer through which the region between the blades can communicate with the annular space. A sealing ring is arranged within the annular space with its width extending across the gap. Upon rotation of the rotor, centrifugal force presses the sealing ring against the radially outer wall of the annular space to seal the gap. The sealing ring may be an elongated strip bent into a ring shape with its ends overlapped. The side edges of the sealing ring may be bent generally toward the center of the annular space.

4 Claims, 6 Drawing Figures

FIG. 3
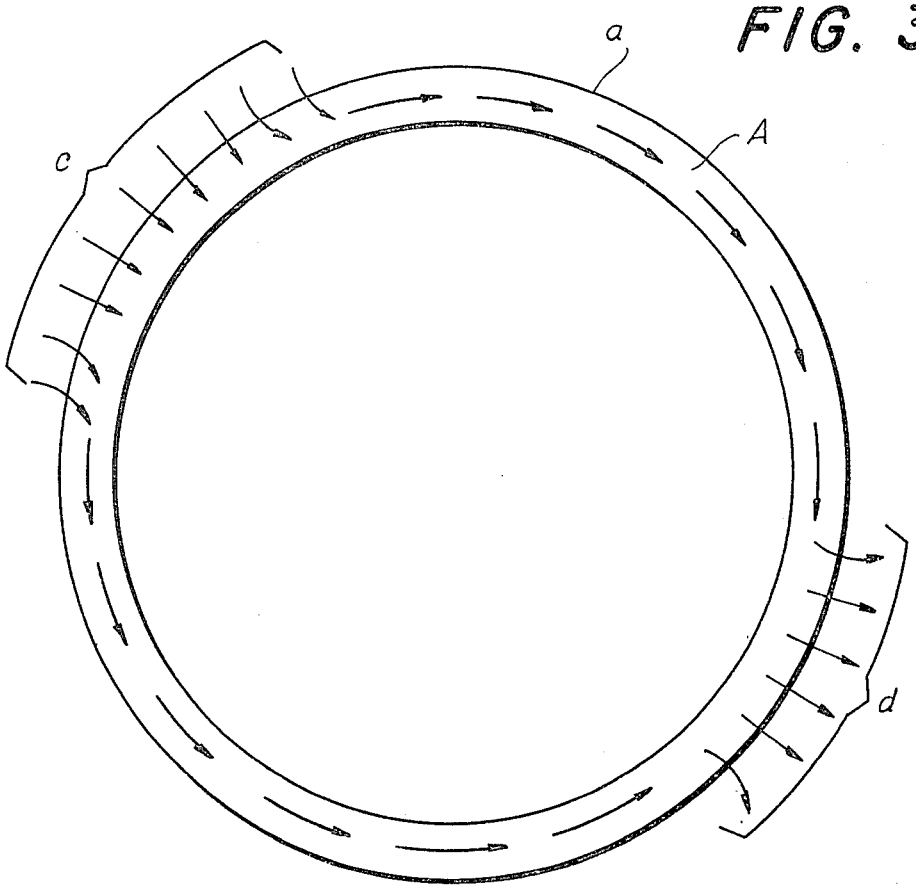
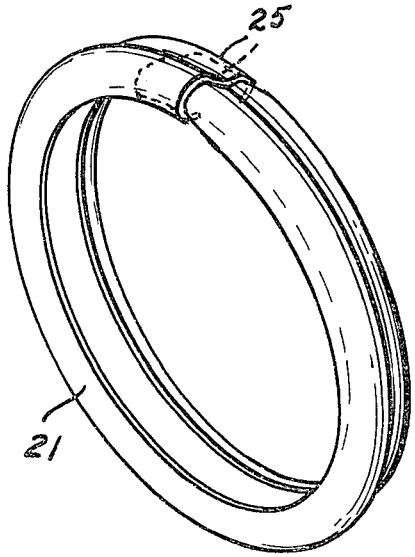
FIG. 4a

TURBOMACHINE ROTOR HAVING A SEALING RING

This invention relates to a recirculation seal for turbomachines, especially turbojet engines. More particularly, the invention involves an arrangement wherein at least the rotor discs of an axial-flow compressor, or of an axial-flow turbine, are axially spaced apart by means of double-T-shaped annular spacers. In such arrangements, the two end edges of the radially-outer T-shaped portion of each spacer are arranged between two successive rows of rotor blades, allowing circumferential gaps to remain between the spacer edges and the associated blade pedestals.

A compressor rotor for turbomachines, such as turbojet engines, having double-T-shaped annular spacers between the rotor discs has been disclosed in U.S. Pat. No. 3,894,324. A serious imperfection encumbering such rotors is that air leakage takes place downstream of each rotor blade, or more precisely between the blade pedestal and the abutting edge of the radially-outer portion of an adjacent spacer, causing pressure losses on one side of the blade and flow losses on the outer.

In an axial-flow compressor of such construction, portions of the compressor air thus flow through the circumferential gaps between the blade pedestals and the abutting edge of a spacer and into the annular space formed, downstream of each row of blades, between the inner contour of one half of the spacer and the abutting root-end surfaces of the rotor disc. From this annular space, the air then passes into spaces formed, upstream of the annular space, radially inwardly of the rotor blade pedestals and also between the blade roots and the blade retaining slots; from there leaking air resurfaces through the axial gaps between adjacent blade pedestals. Apart from aerodynamic interference at the rotor blades, such leakage may also give rise to irregular pressure distribution downstream of the rotor blades which may cause continuous seepage from a high-pressure zone on the circumference, through the annular space, and into a lowpressure zone on the circumference.

In a broad aspect, the present invention eliminates these deficiencies in a very simple manner without unduly complicating the assembly of the rotor.

It is a particular object of the present invention to provide a rotor construction of this generic category wherein an axially preloaded sealing ring is inserted in the annular space formed between the inner contour of one half of the spacer and the abutting root-end surfaces of the rotor disc. The sealing ring is made of a strip of sheet material and, in an approximate adaptation to the annular space contour facing the circumferential gap, is given a shape such that when the sealing ring is under centrifugal load it will closely hug the wall of the annular space to seal off the circumferential gap.

Further objects and advantages of the present invention will become apparent from the following detailed description read together with the accompanying drawings. In the drawings:

FIG. 3 is a schematic representation of the invention in operation, illustrating a possible circumferentially irregular pressure distribution;

Figure 1:
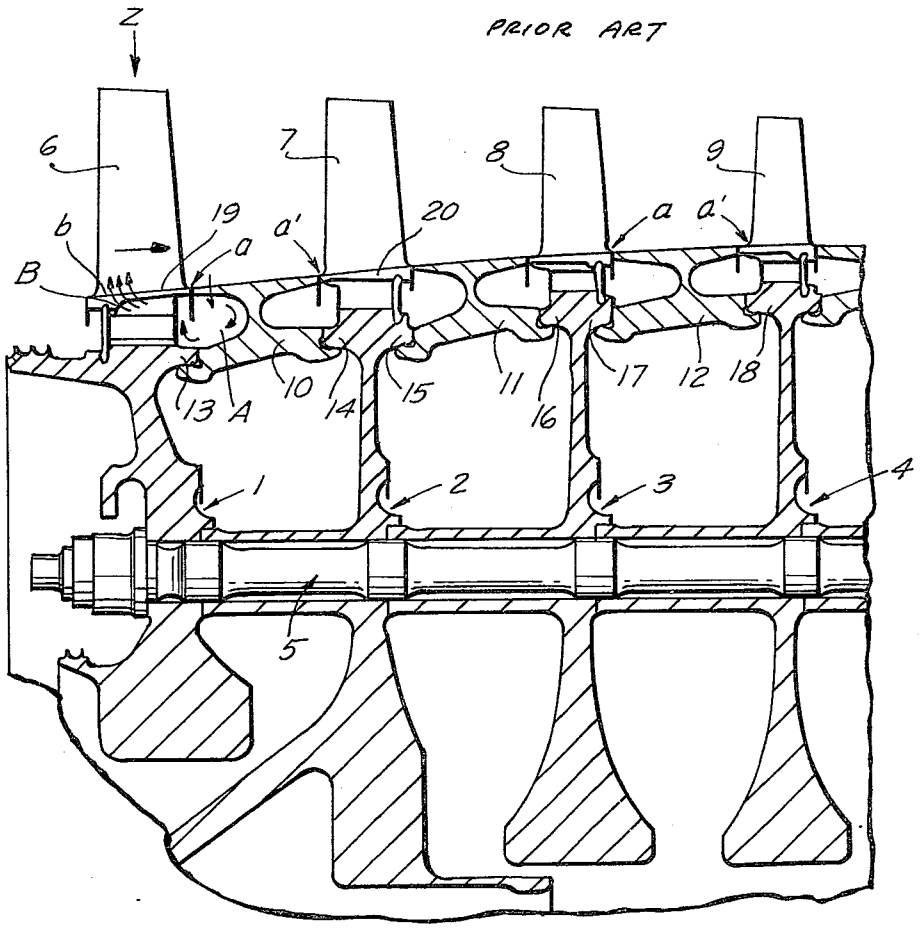
FIG. 1 PRIOR ART
FIG. 1 is a fragmentary longitudinal cross-sectional view along the center-line of an axial-flow compressor rotor, illustrating the air leakage problem.
Figure 4:
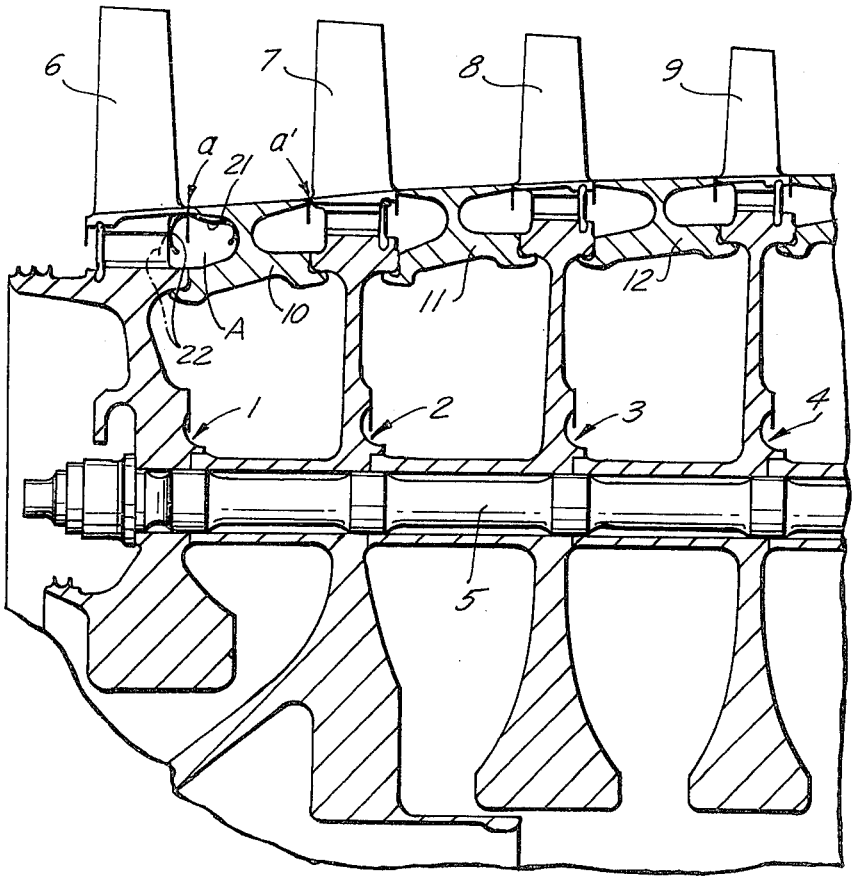
FIG. 4 is a view similar to FIG. 1, showing the position of the sealing strip during assembly.
Figure 5:
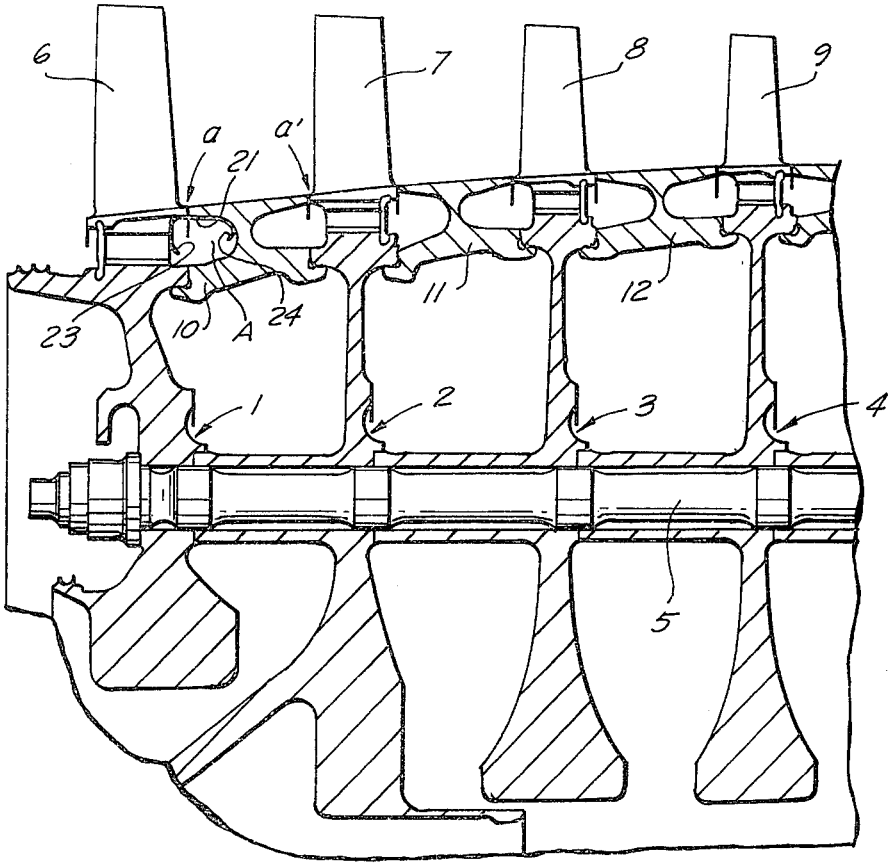

FIG. 4*a* is a perspective view of a sealing ring according to this invention; and FIG. 5 is a view similar to FIG. 1 showing the position of the sealing strip with the rotor in operation.

The several rotor discs 1, 2, 3, and 4 of the axial-flow compressor rotor are held together by suitable means, such as tiebolts 5. The rotor blades carried by the several rotor discs 1, 2, 3, and 4 are consecutively numbered 6, 7, 8, and 9, respectively.

Double-T-shaped annular spacers 10, 11, and 12 are inserted between the rotor discs 1, 2, 3, and 4 in their outer peripheral area. Between axially extending shoulders 13 and 14, 15 and 16, and 17 and 18 of rotor discs 1, 2, 3, and 4, the spacers 10, 11, and 12, respectively, are prevented from relative rotation by their radially-inner, laterally projecting T-sections engaging with the shoulders. All the spacers 10, 11, and 12 leave circumferential gaps *a* and *a'* between the edges of their radially-outer T-portions and the adjacent rotor blade pedestals 19 and 20 of rotor discs 1 and 2.

Figure 2:
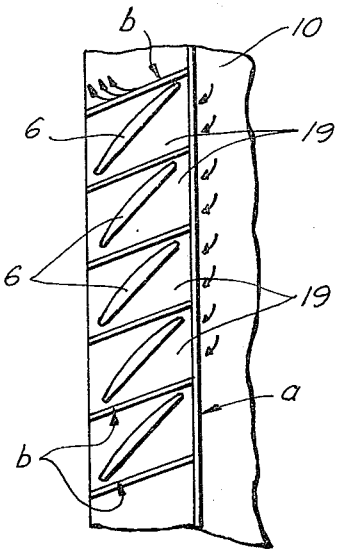
FIG. 2 is a view looking in the direction of arrow Z of FIG. 1 showing one bladed rotor disc.

In operation, portions of the compressor air flow downstream of each blade, say blade 6, through circumferential gap a and into annular space A formed between the contour of the left half of a spacer, say spacer 10, and the adjacent root-end surface of a rotor disc, say rotor disc 1. From annular space A the leaking air enters spaces B formed radially inward of the blade pedestals, say pedestals 19, and also between the blade roots and the blade slots. From there the leaking air resurfaces through axial gaps *b* (see FIG. 2) between the pedestals 19 of rotor blades 6, as indicated by the arrows in FIGS. 1 and 2.

As a result of the leakage just described, irregular pressure distribution may arise circumferentially behind the rotor blades 6, causing continuous seepage from a high-pressure area *c* (see FIG. 3), through the circumferential gap *a*, into annular space A and from there to a low-pressure area *d* on the circumference.

FIG. 4 illustrates the location and the shape of sealing ring 21 installed in annular space A of the axial-flow compressor rotor which is here essentially the same as in FIG. 1. The axially prestressed sealing ring 21 is made from a strip of springy sheet material, such as a suitable metal or plastic. During the assembly of the axial-flow compressor rotor the sealing ring 21 is installed in annulus A of spacer 10 with the ends 25 of the strip overlapping (see FIG. 4*a*). The front edge 22 of the sealing ring initially assumes the position shown in broken lines in FIG. 4. During the subsequent assembly of rotor disc 1, which at this time is still unbladed, the front edge 22 of sealing ring 21 abuts on the root-end humps of rotor disc 1, and is thereby increasingly loaded axially, being pushed into the solid line position in FIG. 4. This spring loading of sealing ring 21 assures firm seating of the ring within space A. When rotor disc 1 has been finally mounted, the blades 6 are assembled with the disc.

FIG. 5 illustrates the operating position of sealing ring 21 under centrifugal load, when it closely hugs the portion of the contour of annular space A which includes circumferential gap *a* to seal off the gap. Comparing FIGS. 4 and 5, it will be seen that when the rotor is stationary, the central portion of sealing ring 21 is bellied radially inwardly (see also FIG. 4*a*), but when the rotor is rotating, centrifugal force presses the sealing ring against the wall of space A, straightening out the bellied region. The bellied shape of sealing ring 21 insures the uniform spreading of the ring along the wall of space A under the influence of centrifugal force, and thereby insures that the ring will seal gap *a*. As is apparent from FIG. 5, sealing ring 21 has edges 23 and 24 which are rolled or bent generally toward the center of annular space A to keep the edges from rubbing on the root-end mating surfaces of rotor disc 1, on one side, and against the mating surfaces of spacer 12, on the other, especially against its web in annular space A.

The invention is suitable especially for a configuration of spacer 10 where, unlike the case of the remaining spacers 11 and 12, no sealing sleeves or similar means are provided between annular space A and intermediate spaces B. If use were made, in lieu of spacers 11 and 12, of a version comparable to spacer 10, the present invention would naturally again eliminate air leakage and seal off the circumferential gaps formed in the vicinity of the rotor blade trailing edges between the end faces of the pedestal and the adjacent face of a spacer.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed is:

1. A rotor for a turbomachine, comprising:

a plurality of rotor disks each carrying radially extending blades, p1 an annular spacer having a substantially double-T-shaped cross-section located between two successive ones of said disks, said spacer and one of said disks defining an annular space between them, and a gap existing between said spacer and one disk through which the region radially outwardly of said spacer and between the blades of the two successive disks communicates with the annular space, and a sealing ring within the annular space, said sealing ring being a strip of springy sheet material having a cross-sectional contour approximating the shape of the radially outer wall of the annular space and arranged with its width extending across the gap, said sealing ring being compressed across its width to axially load it, and the widthwise central portion of said sealing ring being bellied toward the axis of the rotor when the rotor is stationary, said bellied portion being straightened and said sealing ring being pressed by centrifugal force against the radially outer wall of the annular space to seal the gap when the rotor rotates.

2. A rotor as defined in claim 1 wherein said sealing ring is an initially elongated strip bent into a ring shape with its ends overlapped.

3. A rotor as defined in claim 1 wherein the side edges of said sealing ring are bent generally toward the center of the annular space.

4. A rotor as defined in claim 1 wherein each rotor blade is mounted on a platform, the gap being located between opposed edges of a platform and the radially outer T-shaped portion of said spacer.

* * * * *